United States Patent [19]

Hochreuter

[11] 4,059,631

[45] Nov. 22, 1977

[54] POLYCHLOROHYDRIN ETHERS OF TRIS-(HYDROXYMETHYL)-AMINOMETHANE

[75] Inventor: Richard Hochreuter, Oberwil, Switzerland

[73] Assignee: Sandoz Ltd., Basel, Switzerland

[21] Appl. No.: 703,751

[22] Filed: July 9, 1976

Related U.S. Application Data

[62] Division of Ser. No. 503,831, Sept. 6, 1974, Pat. No. 3,987,231.

[51] Int. Cl.[2] ..... C07C 87/06; C07C 43/10

[52] U.S. Cl. ..... 260/584 B

[58] Field of Search ..... 260/584 B

[56] References Cited

U.S. PATENT DOCUMENTS

| | | | |
|---|---|---|---|
| 2,355,337 | 8/1944 | Spence | 260/584 B |
| 3,891,709 | 6/1975 | Higuchi et al. | 260/584 B |
| 3,894,070 | 7/1975 | Tomiyama et al. | 260/584 B X |

FOREIGN PATENT DOCUMENTS

| | | | |
|---|---|---|---|
| 1,308,590 | 2/1973 | United Kingdom | 260/584 B |

*Primary Examiner*—Allen B. Curtis

*Attorney, Agent, or Firm*—Gerald D. Sharkin; Richard E. Vila; Joseph J. Borovian

[57] ABSTRACT

The present invention concerns a novel method of antistatically treating synthetic, semi-synthetic or natural porous material, particularly fibrous material, which comprises applying thereto a polychlorohydrin ether of tris-(hydroxymethyl)-aminomethane and a polyglycol bis-epichlorohydrin in admixture and/or in partially condensed form, and curing the compound(s) on the material.

8 Claims, No Drawings

POLYCHLOROHYDRIN ETHERS OF TRIS-(HYDROXYMETHYL)-AMINOMETHANE

This is a division of application Ser. No. 503,831 filed Sept. 6, 1974, now U.S. Pat. No. 3,987,231.

The present invention relates to the treatment of synthetic, semi-synthetic or natural porous material, particularly fibrous material, to reduce the tendency thereof to accumulate static electricity.

Accordingly, the present invention provides a method of antistatically treating synthetic, semi-synthetic or natural porous material having a tendency to accumulate static electricity, which comprises applying thereto a compound of formula I,

I

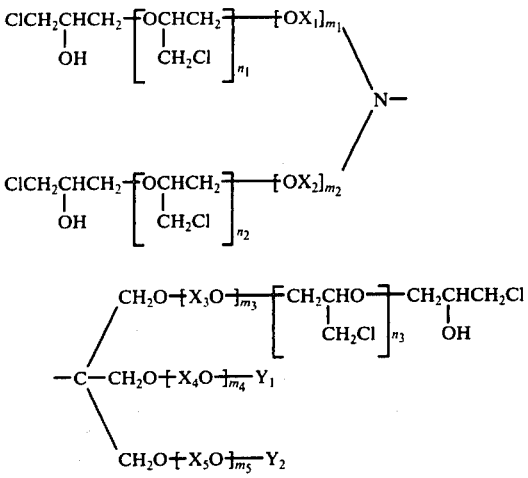

wherein $X_1$, $X_2$, $X_3$, $X_4$ and $X_5$ are each, independently, 1,2-ethylene, 1,2-propylene or 1,2-butylene, $m_1$ and $m_2$ are each, independently, an integer 1 to 30, $m_3$, $m_4$ and $m_5$ are each, independently, 0 or an integer 1 to 30, $n_1$, $n_2$ and $n_3$ are each, independently, 0 or an integer 1 or 2, $Y_1$ is hydrogen or a radical of the formula

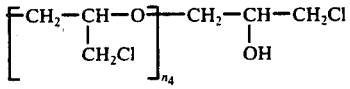

wherein $n_4$ is 0 or an integer 1 or 2, and $Y_2$ is hydrogen or a radical of the formula

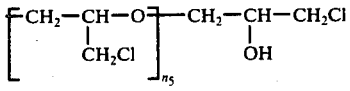

wherein $n_5$ is 0 or an integer 1 or 2, and wherein the sum of $m_1$, $m_2$, $m_3$, $m_4$ and $m_5$ is an integer 2 to 100 and the sum of $n_1$, $n_2$, $n_3$, $n_4$ and $n_5$ is 0 or an integer 1 to 7, in association with a compound of formula II,

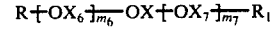

II wherein R is a radical of the formula

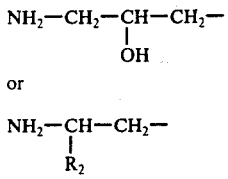

wherein $R_2$ is hydrogen, methyl or ethyl, $R_1$ is $NH_2$— or a radical of the formula

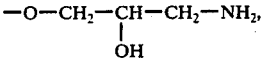

X is alkylene ($C_2$–$C_{12}$), phenylene, diphenyloxy or diphenylsulphone, $X_6$ and $X_7$ are each, independently, 1,2-ethylene, 1,2-propylene or 1,2-butylene, and $m_6$ and $m_7$ are each, independently, an integer 1 to 38, the sum of $m_6$ and $m_7$ being an integer 2 to 39, and/or a precondensate of the compounds of formulae I and II, and curing the applied compound(s) on the material.

In the formulae I and II above, when any of $X_1$, $X_2$, $X_3$, $X_4$, $X_5$, $X_6$ and $X_7$ is a 1,2-propylene or 1,2-butylene group, such group may be arranged either way round, e.g.

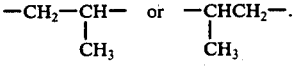

Furthermore, when any one of $m_1$, $m_2$, $m_3$, $m_4$, $m_5$, $m_6$ and $m_7$ is greater than 1, the appropriate repeating units may be the same or different so that each chain $$\left[OX_1\right]_{m_1},\ \left[OX_2\right]_{m_2},\ \left[X_3O\right]_{m_3},\ \left[X_4O\right]_{m_4},$$

$$\left[X_5O\right]_{m_5},\ \left[OX_6\right]_{m_6} \text{ and } \left[OX_7\right]_{m_7},$$

independently, may consist of a plurality of the same or different alkylenoxy units. Moreover, when the repeating chain units are different, they may repeat in an ordered or random pattern.

As will be apparent from the description below, the compounds of formulae I and II and likewise the precondensates thereof are generally produced in the form of mixtures of compounds. While separation of such mixtures may in some cases be possible, in general it is found that such mixtures perform satisfactorily in the method of the invention and therefore separation is not necessary. Accordingly, it is to be understood that the method of the present invention embraces the use of one or more compounds of formula I and of formula II, and/or their preceondensates.

In general, the compounds of formulae I and II employed in the method of the invention are preferably at least partially in precondensate form.

By the term "precondensate" in relation to the compounds of formulae I and II, as employed herein, is meant a partially condensed product thereof having capacity for further condensation by way of cross-linking, e.g. under curing conditions. Such precondensates are characterised by their water solubility and the relatively higher viscosity of their aqueous solutions in relation to those of the compounds of formulae I and II from which they are derived. Such precondensates are novel and also form part of the present invention.

The precondensates of the invention may be produced by dissolving the compounds of formulae I and II in water or in an aqueous water-miscible organic solvent, such as an aqueous alcohol solution, e.g. aqueous isopropanol, under non-acidic conditions, and allowing the reaction to proceed, preferably with stirring. The reaction temperature generally lies in the range 0° to 100° C, preferably above 15° C, more preferably from 20° to 90° C, e.g. 20° to 30° C. The reaction is allowed to proceed until the desired degree of condensation has been effected. The degree of condensation can be followed by observing the increase in viscosity. In general a rection period of between 1 and 4 hours is required in order to obtain some increase in viscosity and yet maintain the reaction mixture in homogeneous and stirrable condition. The reaction may be terminated either by diluting the reaction mixture with water or, more preferably, by acidifying the slightly basic reaction mixture with either organic acids or inorganic acids, preferably the latter, e.g. concentrated hydrochloric acid, to a pH of below 7.0, e.g. between 2.0 and 6.0, more preferably between 5.0 and 6.0. As will be appreciated, acidification of the reaction mixture will cause protonation of the basic amino centres, thus discouraging reaction at these centres. Both free base and protonated forms of the precondensates are within the scope of the present invention.

The ratio by weight of the compounds of formula I to the compounds of formula II, in the production of the precondensate and also for use as a mixture in the method of the invention, will vary depending on the nature of the compounds, e.g. the relative number of chlorohydrin groups and free hydrogen atoms available for reaction, and the nature of the antistatic treatment desired. However, in general, satisfactory results may be obtained when the weight ratio of the compound of formula I to the compound of formula II is 1 : 0.4 to 3, more preferably 1 : 1 to 2, e.g. 1 : 1.5. In general, the weights are preferably arranged to ensure that between 0.1 to 3, more preferably 0.3 to 1.3 chlorohydrin groups of the compound of formula I are available for reaction with each reactive hydrogen atom of the amine of formula II.

For trade and also for storage puposes, the compounds of formulae I and II and/or their precondensates are preferably in the form of a concentrated aqueous solution. Preferably such solutions contain between 10 and 50%, more preferably 20 to 30%, e.g. 25% by weight of the compounds and/or their precondensates. In order to ensure that condensation or further condensation does not ensue on prolonged storage, any basic amino group is preferably converted to protonated form by adjusting the pH to below 7.0, e.g. between 2.0 to 6.0, more preferably 5.0 to 6.0, e.g. 5.5. Application liquors for use in the method of the invention may be prepared from concentrate forms by diluting with water, e.g. to between 1 and 10%, preferably between 2 and 7%, e.g. 5%, by weight concentration and, if necessary, adjusting the pH of the solution to above 5.5, e.g. from 5.5 to 7.0, preferably from 6.0 to 7.0, to enable condensation or further condensation to ensue. Such pH adjustment may be effected by the addition of a water-soluble base, either inorganic, e.g. sodium hydroxide, sodium carbonate or sodium acetate, e.g. or organic, e.g. triethanolamine.

As will be appreciated from the foregoing description, the tendency of the compounds of formulae I and II and/or precondensates thereof, to condense or as the case may be, further condense, will depend on three basic parameters, namely pH, temperature and concentration. Accordingly, the preparation of stable concentrated solutions or suitable application liquors will therefore necessitate consideration of the inter-relation between the above mentioned parameters.

The application liquors may be applied by the so-called Foulard process, which comprises padding or spraying the liquor onto the porous material to be treated, expressing a proportion of the liquid carrier, preferably to obtain between 60 and 80%, e.g. 70% by weight take-up, based on the dry weight of the material, and then curing the liquor by heating. Suitable curing temperatures are between 60° and 150° C, preferably between 100° and 150° C, e.g. 140° C. The curing period will depend inter alia on the curing temnperature, but in general will lie in the range of 30 seconds to 10 minutes. Conveniently, the curing step is simultaneously effected when drying the treated material.

Preferably, the treatment results in an increase of the dry weight of the material of from 0.1 to 6%, more preferably 1 to 4%.

Apart from the compounds of formulae I and II and/or their precondensates, the application and concentrate forms thereof may also contain other chemical treating agents, for example, softening agents, water repellants, dyes or pigments.

Synthetic, semi-synthetic or natural materials, suitable for treatment by the method of the invention, are preferably of fibrous form. The method is particularly suited to the treatment of paper, cotton or wool, or fibrous cellulose acetate, synthetic polyamides, polyester or polyacrylonitrile or blends of such materials, e.g. polyester/cotton blend fabrics.

Apart from their reduced tendency to accumulate static electricity, materials treated in accordance with the present invention do not exhibit any undue tendency to soil and the soft handle of the material is not unduly affected. The antistatic treatment in accordance with the invention is, moreover, notably durable, possessing notable wash fastness under both domestic washing and dry cleaning conditions. The method of the invention may also advantageously be effected in conjunction with other material treatments, for example, pigmentation or anionic dyeing. Thus, pigments, e.g. as prints, may be fixed by a simultaneous antistatic treatment, e.g. by incorporating the compounds of formulae I and II and/or a precondensate thereof in the printing paste. In addition, the affinity of anionic dyes for the material and the steam resistant properties of the anionic dyeings may be improved by an antistatic treatment of the material prior to or during dyeing.

Preferred compounds for formula I, either in the method of the invention or in the production of the precondensates of the invention, are the compounds wherein i. the sum of $m_1$, $m_2$, $m_3$, $m_4$ and $m_5$ is an integer 2 to 20, particularly when each of $m_1$ and $m_2$ is independently an integer 1 to 4 and each of $m_3$, $m_4$ and $m_5$ is independently 0 or an integer 1 to 4;

ii. $X_1$, $X_2$, $X_3$, $X_4$ and $X_5$ are each, independently, 1,2-ethylene or 1,2-propylene, more preferably, 1,2-ethylene; and/or iii. each of $n_1$, $n_2$, $n_3$, $n_4$ and $n_5$ is 0.

Thus, particularly preferred compounds are the compounds of formula I*a*.

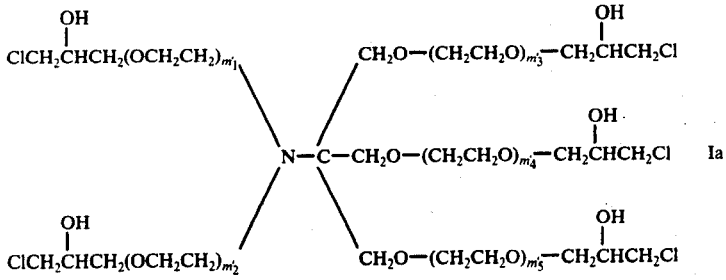

Ia wherein $m_1'$ and $m_2'$ are each, independently an integer 1 to 19, and $m_3'$, $m_4'$ and $m_5'$ are each, independently 0 or an integer 1 to 18, the sum of $m_1'$, $m_2'$, $m_3'$, $m_4'$ and $m_5'$ being 2 to 20, especially the compounds wherein the sum of $m_1'$, $m_2'$, $m_3'$, $m_4'$ and $m_5'$ is 15.

Preferred compounds of formula II, either in the method of the invention or in the production of the precondensates of the invention are the compounds wherein i. X is 1,2-ethylene, 1,2-propylene or 1,2-butylene, and, more preferably, each of X, $X_6$ and $X_7$ is, independently, 1,2-ethylene or 1,2 -propylene, especially when X, $X_6$ and $X_7$ are the same;

ii. the sum of $m_6$ and $m_7$ is an integer 4 to 22, especially 12 or 13;

and/or iii. R is a radical

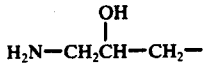

and/or $R_1$ is a radical

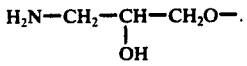

Thus, particularly preferred compounds of formula II are the compounds of formula II*a*,

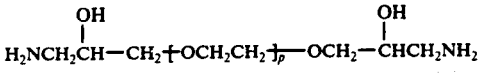

IIa wherein

*p* is an integer 5 to 23, especially an integer 13 or 14.

The compounds of formula I are novel and also form part of the present invention. They may be produced, in accordance with a further aspect of the invention, by a process which comprises condensing a compound of formula III,

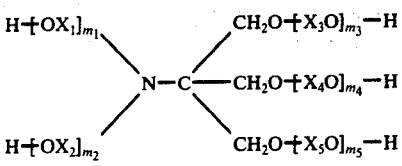

III wherein $X_1$, $X_2$, $X_3$, $X_4$, $X_5$, $m_1$, $m_2$, $m_3$, $m_4$ and $m_5$ are as defined above, with epichlorohydrin, in a molar ratio of 1 : 3 to 12 respectively.

The process may be effected by the addition of epichlorohydrin to the compound of formula III at a temperature between 90° and 110° C. Preferably a small amount, e.g. 1 to 3 parts by weight, based on the weight of the compound of formula III, of a condensation catalyst, especially a strong Lewis acid, in particular tin tetrachloride or boron trifluoride etherate, is added to assist the condensation. The reaction is allowed to proceed until no further epichlorohydrin distils off.

The compounds of formula III, employed as starting material in the production of the compounds of formula I, may be produced by alkoxylating a compound of formula IV,

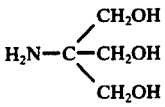

IV with 1,2-ethylene oxide, 1,2-propylene oxide and/or 1,2-butylene oxide in a molar ratio of 1 : 2 to 100 respectively.

The reaction may be effected by the addition of the alkylene oxide to the compound of formula IV at a temperature of between 155° and 180° C, in the presence of a small amount, e.g. 1 to 2% by weight based on the weight of the compound of formula IV, of an alkali, for example, sodium hydroxide, and the reaction allowed to proceed at the above temperature for sufficient period to allow complete alkylation.

In practice, it is not necessary to isolate the resulting compounds of formula III, the reaction mixture being employed directly in the production of compounds of formula I by reducing the temperature thereof to 90° to 110° C and addition thereto of epichlorohydrin together with, if required, a condensation catalyst.

The compounds of formula II, employed in the method or in the production of the precondensate of the invention, may be produced by alkoxylating a compound of formula V, $$HO - X - OH \qquad V$$

wherein X is as defined above,
with ethylene oxide, propylene oxide and/or 1,2-butylene oxide, in a molar ratio of 1 : 2 to 39 (or 1 : 2 to 40 when R is a radical $$-CH_2\underset{\underset{R_2}{|}}{C}HNH_2)$$

respectively, to produce an alkoxide adduct, e.g. polyglycol 600, and a. converting at least one terminal —OH group of the resulting alkoxide adduct to a more reactive group, e.g. chlorine, and condensing with ammonia and/or b. condensing the resulting alkoxide adduct or a monoaminated product from a) above with epichlorohydrin and converting the terminal chlorine atom(s) of the resulting product to amino group(s) by reaction with ammonia.

The alkoxylation of the compound of formula V to produce the alkoxide adduct may be effected in manner known per se, e.g. by adding the alkylene oxide to the diol of formula V, at an elevated temprature, e.g. 220°-240° C. The resulting alkylene oxide adduct is then reacted with, for example, a chlorinating agent, such as thionyl chloride in accordance with process variant a) or with epichlorohydrin at an elevated temperature, e.g. 70° to 80° C, in the presence of a strong Lewis acid as catalyst, e.g. tin tetrachloride or boron trifluoride etherate in accordance with process variant b). The terminal chlorine atoms in each of the resulting products are converted to amino groups by adding thereto an aqueous ammonia solution at a temperature of from 15° to 25° C in the presence of an alkali, e.g. sodium hydroxide.

Examples of compounds of formula V are 1,2-ethylene glycol, 1,3-propylene glycol, 1,4-butylene glycol, 1,5-pentamethylene glycol, 1,6-hexamethylene glycol, 1,10-decamethylene glycol, 4-hydroxyphenol, 4,4'-dihydroxy diphenylether and 4,4'-dihydroxy diphenylsulphone. Of the alkylene oxides mentioned above as alkoxylating agents, ethylene oxide and propylene oxide are preferred.

In the following Examples, which illustrate the invention, parts and percentages are by weight and the temperatures are in degrees Centigrade.

EXAMPLE 1 a. Compound of formula I

A polychlorohydrin ether of formula I is produced by alkoxylating 121 parts (1 mol) of tris-(hydroxymethyl)-amino methane with 145 parts (2.5 mols) of propylene oxide at a temperture of between 155° to 175°. When alkoxylation is complete, 462 parts (5 mols) of epichlorohydrin and 2.1 parts of tin tetrachloride are added to the reaction mixture containing the resulting propylene oxide adduct, the temperature being maintained at 95° to 100° C throughout the reaction.

The structure of the compound produced corresponds to formula I wherein $n_1$ to $n_5$ are each 0, the sum of $m_1$ to $m_5$ is 3, $X_1$ and $X_2$ are each 1,2-propylene and $Y_1$ and $Y_2$ are each $$-CH_2-\overset{\overset{OH}{|}}{C}H-CH_2Cl.$$

b. Compound of formula II

A polyglycol diamine of formula II is produced by condensing 300 parts (0.5 mols) polyglycol 600 in the presence of 3 parts tin tetrachloride at 75° with 92.5 parts (1 mol) epichlorohydrin. The resultant polyglycol bis-epichlorohydrin ether is then added at 20° to 25° to a mixture consisting of 126 parts 30% aqueous sodium hydroxide solution and 136 parts 25% aqueous ammonia solution. The reaction mixture is then heated to 70° and the excess ammonia and water is distilled off completely under vacuum.

The residue containing the polyglycol diamine is dissolved in 334 parts by water to form a fairly viscous approximately 50% aqueous solution.

The structure of the resulting polyglycol diamine corresponds to formula II*a* where *p* is 13 or 14.

c. Concentrated aqueous precondensate

A 25% aqueous precondensate concentrate is produced by dissolving 19 parts (0.03 mols) of the polychlorohydrin ether described in part a) above, in 19 parts of water and adding dropwise 75 parts (0.05 mols) of the polygylcol amine solution described in part b) above, at 25° C (weight ratio of compound of formula I to compound of formula II being 1 : 2). After stirring the mixture for 2 hours at 25° C, the solution is stabilised by acidification with concentrated hydrochloric acid to a pH of 6.0.

d. Antistatic treatment

The precondensate concentrate described in part c) above is diluted with water to a concentration of 200 gm of the 25% precondensate condensate per liter of solution and the pH is adjusted to 6.2 by the addition of sodium acetate. The resulting application liquor is applied to woven fabrics of polyester, polyacrylonitrile and polyamide in a padding machine, the liquor taken up being restricted by rolling or hydroextraction to a level of 70% based on the weight of the fabric. The treated material is then dried at 140° C for 1 minute, curing of the treatment occurring simultaneously. The antistatically treated fabrics exhibit an increase in dry weight of 3.5%.

EXAMPLE 2

The compound of formula II is produced in the manner described in Example 1 part b) except that instead of adding the polyglycol bis-epichlorohydrin ether to a mixture of sodium hydroxide and ammonia, the sodium hydroxide solution and then the ammonia solution are added to the polyglycol bis-epichlorohydrin ether dropwise at 10° to 15° C.

The procedures set out in Example 1 are otherwise followed.

EXAMPLE 3

Compounds of formula II are produced in the manner described in Example 1 part b) except that the 300 parts (0.5 mols) of polyglycol 600 are replaced by 600 parts (0.5 mols) of polyglycol 1200 or 150 parts (0.5 mols) of polyglycol 300 in the reaction with 92.5 parts (1 mol) of epichlorohydrin.

The precedures set out in Example 1 are otherwise followed.

EXAMPLE 4 a. Compound of formula I

A polychlorohydrin ether of formula I is produced by alkoxylating 121 parts (1 mol) of tris-(hydroxymethyl)-aminomethane at 160-175° with 660 parts (15 mols) of ethylene oxide. When alkoxylation is complete, 462 parts (5 mols) of epichlorohydrin and 2.1 parts of tin tetrachloride are added to the reaction mixture containing the resulting ethylene oxide adduct, the temperature being maintained at 95° to 100° C throughout the reaction.

The structure of the compound produced corresponds to formula I*a* wherein the sum of $m_1'$, $m_2'$, $m_3'$, $m_4'$ and $m_5'$ is 15.

b. Concentrated aqueous precondensate

A 25% aqueous precondensate concentrate is produced by dissolving 83 parts of the polychlorohydrin ether described in part a) above, in a solvent mixture consisting of 153 parts of water and 53 parts of isopropanol and adding to the solution so obtained, dropwise at 25° C, 150 parts of the polyglycol amine solution described in Example 1 part b) (weight ratio of compound of formula I to compound for formula II being 1 : 0.9). After stirring the mixture for 1 hour at 25°, the solution is stabilised by acidification with 8.5 parts of concentrated hydrochloric acid to a pH of 5.5.

c. Antistatic treatment

The precondensate concentrate described in part b) above is diluted with water to a concentration of 200 gm of the 25% precondensate condensate per liter of solution and the pH is adjusted to 7.0 by the addition of 3 gm of sodium bicarbonate. The resulting application liquor is applied to polyester, polyacrylonitrile and polyamide woven fabrics in the manner described in Example 1 part d). Increase in dry weight is 3.5%.

In a slight modification of part a) of this Example, 450 parts of polyglycol amine solution are employed instead of 150 parts (the weight ratio of the compound of formula I to compound of formula II being 1 : 2.7).

EXAMPLE 5

The compound of formula I is produced in the manner described in Example 4 part a) except that instead of employing 83 parts of the polychlorohydrin ether employed therein, 150 parts of a polyhydrin ether produced by the addition of 132 parts (3 mols) ethylene oxide to 121 parts (1 mol) of tris-(hydroxy methyl)-amine methane is employed.

The procedure set out in Example 4 is otherwise followed.

EXAMPLE 6 a. Compound of formula I

A polychlorohydrin ether of formula I is produced by alkoxylating 242 parts (2 mols) of tris-(hydroxy methyl)-amine methane with 220 parts (5 mols) of ethylene oxide at a temperature between 160° to 175°. When alkoxylation is complete, 925 parts (10 mols) of epichlorohydrin and a catalytic amount of tin tetrachloride are added to the reaction mixture containing the resulting ethylene oxide adduct, the temperature being maintained at 95° to 100° C throughout the reaction.

The structure of the compound produced corresponds to formula I*a* wherein the sum of $m_1'$, $m_2'$, $m_3'$, $m_4'$ and $m_5'$ is 2 or 3.

b. Concentrated aqueous precondensate

A 25% aqueous precondensate concentrate is produced by dissolving 30 parts of polychlorohydrin ether described in part a) above, in a solvent mixture consisting of 55 parts of water and 20 parts of isopropanol and adding to the the resulting solution, dropwise, at 25° to 30°, 150 parts of the polyglycol amine solution described in Example 1 part b) (weight ratio of compound of formula I to compound of formula II being 1 : 2.5). After stirring the mixture for 2 hours, the solution is stabilised by acidification with 8 parts of concentrated hydrochloric acid to a pH of 5.5.

c. Antistatic treatment

The precondensate concentrate described in part b) above is diluted with water to a concentration of 200 gm of the 25% precondensate concentrate per liter of solution and the pH of the solution is adjusted to 6.9 by addition of 5 gm of sodium bicarbonate. The resulting application liquor is applied to polyester, polyacrylonitrile and polyamide woven fabrics in the manner described in Example 1 part d).

In a slight modification of part b) of this Example, the degree of condensation in the production of the precondensate is increased by heating the mixture to 80° for 4 hours, whereupon a pronounced increase in viscosity of the precondensate solution is observed, the solution still being homogeneous and well-stirrable.

EXAMPLE 7 a. Concentrated aqueous precondensate

The process of Example 4 part b) is repeated employing 83 parts of the polychlorohydrin ether described in Example 4 part a) and 80 parts of a 50% solution of a polyglycol diamine of the formula

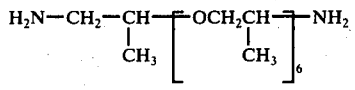

(the weight ratio of the compound of formula I to compound of formula II being 1 : 0.5) to produce a yellowish concentrated solution (25% concentrate).

b. Antistatic treatment

The precondensate concentrate produced as described in part a) above is diluted with water to a concentration of 200 gm of the 25% precondensate concentrate per liter of solution and the pH is adjusted to 6.0 by the addition of sodium acetate. The resulting application liquor is applied to polyester, polyacrylonitrile and polyamide woven fabrics in the manner described in Example 1 part d).

EXAMPLE 8 a. Compound of formula II

A polyglycol diamine of formula II is produced by alkoxylating 125 parts (0.5 mol) of dihydroxy diphenyl sulphone with 330 parts (7.5 mols) of ethylene oxide at 220° to 240°. To the brown viscous liquid so produced, is added 2 parts of tin tetrachloride and 37 parts (0.4 mol) epichlorohydrin and the mixture reacted at 70°. When the reaction is complete, the reaction mixture is cooled to 20° to 25° and 51 parts of a 30% aqueous sodium hydroxide solution and 55 parts of a 25% aqueous ammonia solution added thereto. After the amination, the excess ammonia is removed by heating to 70°. The residue is dissolved in water to produce a 50% aqueous solution of the polyglycol diamine.

b. Concentrated aqueous precondensate

A 25% aqueous precondensate concentrate is produced by dissolving 83.5 parts of the polychlorohydrin ether described in Example 4 part a), in a solvent mixture consisting of 40 parts of water and 55 parts of isopropanol. 223 Parts of the 50% polyglycol diamine solution described in part a) above is added to the resulting solution (the weight ratio of the compound of formula I to the compound II being 1 : 1.3), dropwise at 20° to 25° and the mixture stirred for 2 hours. The pH of the mixture is then adjusted to 5.6 by the addition of 9.4 ml concentrated hydrochloric acid.

c. Antistatic treatment

The precondensate concentrate described in part b) above is diluted with water to a concentration of 100 parts of the 25% aqueous precondensate per liter of solution and 15 parts of sodium acetate added per liter of solution giving a pH value of 6.5. The almost neutral application liquor so produced is applied to polyester, polyacrylonitrile and polyamide woven fabrics in accordance with the procedure described in Example 1, part d), the antistatic treatment resulting in an increase in 1.7% in the dry weight of the treated fabrics.

EXAMPLE 9 a. Compound of formula I

A polychlorohydrin ether of formula I is produced by alkoxylating 60 parts (0.5 mol) of tris-(hydroxymethyl)-aminomethane with 110 parts (2.45 mols) of ethylene oxide at a temperature between 160° to 175°. When alkoxylation is complete, 231 parts (2.15 mols) of epichlorohydrin and a catalytic amount of tin tetrachloride are added to the reaction mixture containing the resulting ethylene oxide adduct, the temperature being maintained at 95° to 100° C.

The structure of the compound produced corresponds approximately to formula I wherein $n_1$ to $n_5$ are each 0, the sum of $m_1$ to $m_5$ is 5, $X_1$ and $X_2$ are each ethylene and $Y_1$ is hydrogen or

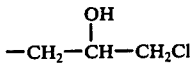

and $Y_2$ is

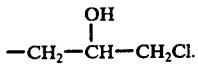

b. Concentrated aqueous precondensate

A 25% aqueous precondensate concentrate is produced by dissolving all of the polychlorohydrin ether produced as described in part a) above, in a solvent mixture consisting of 700 parts of water and 240 parts of isopropanol and adding thereto, dropwise, 300 parts of the polyglycol diamine described in Example 1 part b), (the weight ratio of the compound of formula I to the compound of formula II being 1 : 0.4), the mixture being stirred for 4 hours at 25° to 30°. The 25% concentrate so obtained is stabilised by the addition of concentrated hydrochloric acid to obtain a pH of 5.5.

c. Antistatic treatment

The precondensate described in part b) above is diluted with water to a concentration of 200 parts of the 25% aqueous precondensate per liter of solution and the solution so produced is rendered weakly acidic to neutral (pH 5.2) by the addition of sodium acetate. The resulting application liquor is applied to polyester, polyacrylonitrile and polyamide woven fabrics in accordance with the procedure described in Example 1 part d).

What is claimed is:

1. A compound of formula I,

I

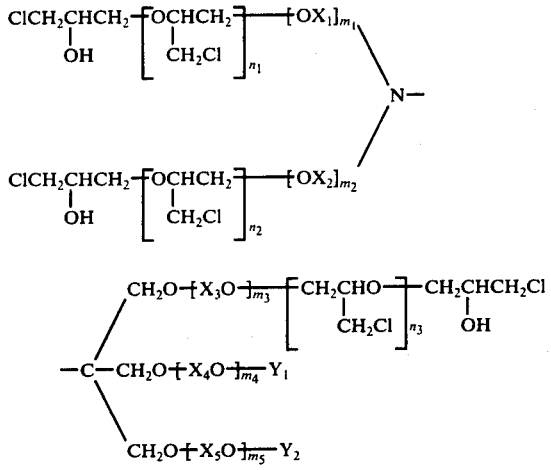

wherein $X_1$, $X_2$, $X_3$, $X_4$ and $X_5$ are each, independently, 1,2-ethylene, 1,2-propylene or 1,2-butylene, $m_1$ and $m_2$ are each, independently, an integer 1 to 30, $m_3$, $m_4$ and $m_5$ are each, independently, 0 or an integer 1 to 30, $n_1$, $n_2$ and $n_3$ are each, independently, 0 or an integer 1 or 2, $Y_1$ is hydrogen or a radical of the formula

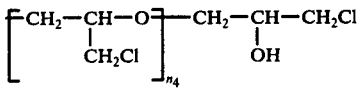

wherein $n_4$ is 0 or an integer 1 or 2, and $Y_2$ is hydrogen or a radical of the formula

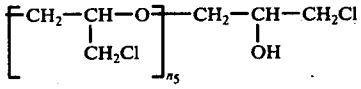

wherein $n_5$ is 0 or an integer 1 or 2, and wherein the sum of $m_1$, $m_2$, $m_3$, $m_4$ and $m_5$ is an integer 2 to 100, and the sum of $n_1$, $n_2$, $n_3$, $n_4$ and $n_5$ is 0 or an integer 1 to 7.

2. A compound according to claim 1, wherein the sum of $m_1$, $m_2$, $m_3$, $m_4$ and $m_5$ is an integer 2 to 20.

3. A compound according to claim 2, wherein each of $m_1$ and $m_2$ is, independently, an integer 1 to 4 and each of $m_3$, $m_4$ and $m_5$ is, independently, 0 or an integer 1 to 4.

4. A compound according to claim 1, wherein $X_1$, $X_2$, $X_3$, $X_4$ and $X_5$ are each, independently, 1,2-ethylene or 1,2-propylene.

5. A compound according to claim 4, wherein each of $X_1$, $X_2$, $X_3$, $X_4$ and $X_5$ is 1,2-ethylene.

6. A compound according to claim 1, where $n_1$, $n_2$, $n_3$, $n_4$ and $n_5$ are each 0.

7. A compound according to claim 1, of formula Ia,

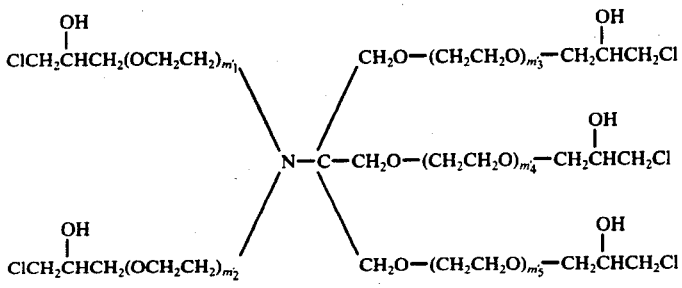
Ia
wherein
$m_1'$ and $m_2'$ are each, independently, an integer 1 to 19, and
$m_3'$, $m_4'$ and $m_5'$ are each, independently, 0 or an integer 1 to 18, the sum of $m_1'$, $m_2'$, $m_3'$, $m_4'$ and $m_5'$ being 2 to 20.
8. A compound according to claim 7, wherein the sum of $m_1'$, $m_2'$, $m_3'$, $m_4'$ and $m_5'$ is 15.
* * * * *